US007158863B1

(12) United States Patent
Johnson

(10) Patent No.: US 7,158,863 B1
(45) Date of Patent: Jan. 2, 2007

(54) PROGRAMMABLE CONTROLLER FOR CONDITION AIR CURTAINS

(75) Inventor: David A. Johnson, New Castle, PA (US)

(73) Assignee: Berner International Corporation, New Castle, PA (US)

( * ) Notice: Subject to any disclaimer, the term of this patent is extended or adjusted under 35 U.S.C. 154(b) by 0 days.

(21) Appl. No.: 11/079,831

(22) Filed: Mar. 14, 2005

Related U.S. Application Data

(60) Provisional application No. 60/554,547, filed on Mar. 18, 2004.

(51) Int. Cl.

| | |
|---|---|
| ***G05B 13/00*** | (2006.01) |
| ***G05B 15/00*** | (2006.01) |
| ***G05B 11/00*** | (2006.01) |
| ***G05D 23/00*** | (2006.01) |
| ***A47F 3/04*** | (2006.01) |

(52) U.S. Cl. ..... 700/278; 700/20; 700/300; 62/256

(58) Field of Classification Search ..... 700/9, 700/11, 17, 19, 20, 83, 275, 276, 299, 300, 700/278; 236/1, 49.3; 62/255, 256
See application file for complete search history.

(56) References Cited

U.S. PATENT DOCUMENTS

| | | | | |
|---|---|---|---|---|
| 3,797,373 | A | 3/1974 | Larson | |
| 4,298,946 | A | 11/1981 | Hartsell et al. | |
| 4,516,482 | A * | 5/1985 | Smith | 454/191 |
| 4,606,401 | A | 8/1986 | Levine et al. | |
| 4,969,508 | A * | 11/1990 | Tate et al. | 165/209 |
| 5,259,553 | A * | 11/1993 | Shyu | 236/49.3 |
| 5,817,003 | A * | 10/1998 | Moll et al. | 600/22 |
| 5,924,486 | A * | 7/1999 | Ehlers et al. | 165/238 |
| 6,595,429 | B1 | 7/2003 | Carlson et al. | |
| 6,619,052 | B1 | 9/2003 | Nash, Jr. | |
| 6,679,080 | B1 * | 1/2004 | Chiang et al. | 62/246 |
| RE38,453 | E * | 3/2004 | Lessard et al. | 237/3 |
| 6,809,301 | B1 * | 10/2004 | McIntyre et al. | 219/506 |
| 6,874,331 | B1 * | 4/2005 | Chandler et al. | 62/256 |
| 6,981,385 | B1 * | 1/2006 | Arshansky et al. | 62/155 |
| 2003/0014817 | A1 * | 1/2003 | Gallant et al. | 5/600 |
| 2003/0150394 | A1 * | 8/2003 | Wolfe | 119/246 |

* cited by examiner

*Primary Examiner*—Crystal J. Barnes
(74) *Attorney, Agent, or Firm*—Harpman & Harpman

(57) ABSTRACT

A programmable electronic controller that provides multiple command and control instruction for an air curtain being integrated therewith. The controller includes operational controls for fan speed, time adjustment duration including time delay, start time, stop time with internal selectable timer clock provisions. The temperature imputable parameters for on demand heat and a variety of remote sensing and actuation output and input provisions.

7 Claims, 2 Drawing Sheets

PROGRAMMABLE CONTROLLER FOR CONDITION AIR CURTAINS

This application claims benefit of U.S. Provisional Application No. 60/554,547, filed Mar. 18, 2004.

BACKGROUND OF THE INVENTION

1. Technical Field

This device relates to air supply and conditioning devices specifically air curtains that generate a controlled stream of air to separate two distinct environments in a variety of operational venues.

2. Description of Prior Art

Prior art devices of this type have been developed to provide air barriers between contrasting temperature conditions such as between conditioned air space and unconditioned air space.

Typically, air curtains are used as an effective fluid barrier which will not restrict object transfer while maintaining the desired environmental conditions within the access space. Such prior art air curtains are positioned either above or on the side of a threshold to be controlled utilizing multiple fans and directional airflow nozzles, see for example U.S. Pat. No. 3,797,373 as representative of same.

Current air curtain design and controls allow for selective heating or cooling of the barrier air stream utilizing a collection of independent control parameters such as air speed, cooling or heating activation and selective on/off controls. Such independent control activation configurations can be seen generally, for example, in U.S. Pat. Nos. 6,595,429 and 6,619,052.

Other electronic control devices for heating and air conditioning controllers are well established within the art such as temperature controls; see for example electronically controlled programmable thermostats; U.S. Pat. Nos. 4,298,949 and 4,606,401.

U.S. Pat. No. 3,797,373 is directed to a basic air curtain device.

U.S. Pat. No. 6,619,052 claims a variable air curtain velocity control for supermarket refrigeration product display cases b controlling fans to alternate the airflow rate.

U.S. Pat. No. 6,595,429 if directed towards an operation and method for providing real time condition air curtain utilizing electronic control heating and fan using air characteristic inputs from temperature pressure and flow rate sensors within the control system.

Finally, U.S. Pat. Nos. 4,298,946 and 4,606,401 utilize electronic programmable thermostats with means for selective ambient temperature compared with a pre-programmed set point and activation appropriate heating and/or air cooling equipment controlled by the thermostat. Such thermostats are well known and understood within the art.

No known prior art provides for integral digital programmable controller for an air curtain which combines a wide range of control functions in an integrated application to configure air curtain performance to the individual use variant requirements.

SUMMARY OF THE INVENTION

A programmable air curtain controller that provides a variety of interdependent demand and control functions using multiple internal and remote sensors in communication with a microprocessor configured to meet specific air curtain control elements. Predetermined and preset operational parameters specify to the operational environment and venues are stored within the controller allowing a single integrated intelligent switch controller to regulate all aspects of air curtain performance by remote control input.

DETAILED DESCRIPTION OF THE INVENTION

Figure 1:
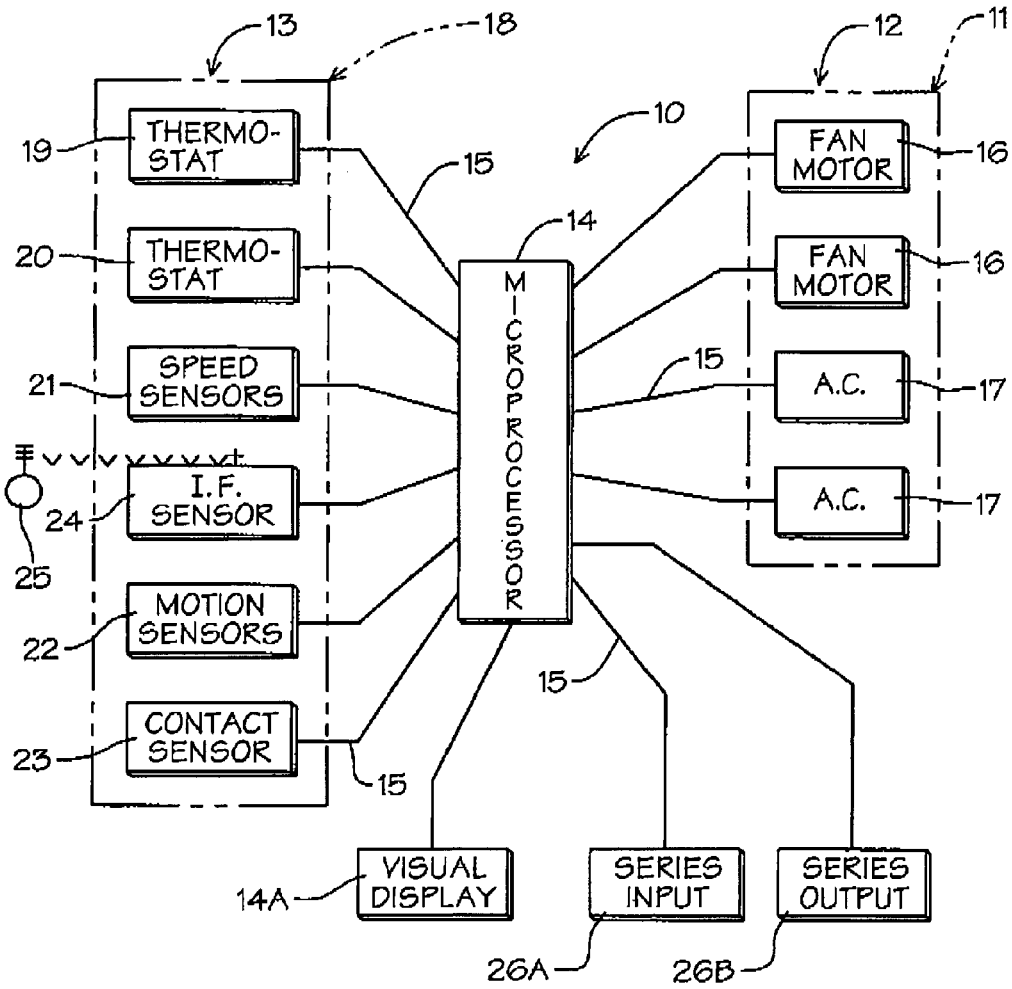
FIG. 1 is a block flow functional diagram outlining the overall control inputs and activation control elements.

Referring now to FIG. 1 of the drawings, an electronic controller 10 of the invention is illustrated in a graphic block flow configuration inclusive of an air curtain 11 indicated by broken lines responsive to control element groupings 12 and 13 as will be discussed in greater detail hereinafter.

A programmable microprocessor 14 of the controller 10 of the invention and proprietary electronic circuits (not shown) which provide for an integrated communication network 15 illustrated by communication lines to control the operation of the air curtain control element groupings 12 and 13. Such control elements included in this example are multiple fan motor assemblies 16 with adjustable velocities with associated air conditioning elements 17 for heating and cooling of the air curtain 11 air source. The fan motor assembly 16 supply an air velocity disturbance outflow from the air curtain creating an effective "barrier" or air curtain at a threshold between two divergent environmental areas.

Information data input element groupings 18 indicated by inclusive broken lines interlinked via the communication network 15 as hereinbefore described to the microprocessor 14 and air curtain control group 13. Such multiple information data source inputs are defined by a remote thermostat 19, internal control thermostat 20, motor fan speed maintaining sensors 21 along with threshold proximity motion sensors 22 and threshold contact sensors 23 such may be required in certain use venue conditions for access threshold indication.

An infrared sensor 24 is provided with the data source inputs which will receive coded input data signals from an infrared remote transmitter 25. The combination of data input element group 18 of the control group 13 and control element group 12 provide the necessary functions for the process controller of the air curtain 11 to assure proper and effective operation in application and installation settings as follows.

Application influence would include effective mounting height and size of the air curtain for the air stream required. Additional criteria such as air curtain mounting location and environmental factors including determination of prevailing winds, geographic location of installation site as well as existing conditions, such as structure pressurization, or negative pressure and threshold obstructions will all be determining factors in control requirements, their performance of the air curtain and the requirements of the electronic controller 10 of the invention.

Installation settings are defined within the art such as air curtain 11 air speed setting to match application thresholds, automatic operation by interfacing with threshold access elements utilizing motion sensors 22 and threshold access contact sensors 23 as well as the supplemental heating and cooling with operation application optimization enclosure of high speed fan and motor assemblies 16 including start, delay and off cycling therefore the air curtain 11 all of which, as noted, are well known and understood by those skilled in the art and do not require further additional detailed explanation or supplemental illustration within the specification.

A visual display unit 14A is provided for the electronic controller 10 of the invention and is in communication with the microprocessor 14 to provide visual indication of input and preset performance parameters.

The air curtain controller 10 of the invention has serial input and output connections at 26A and 26B which provide for serial connection to additional controllers (not shown) if needed in multiple unit applications.

Figure 2:
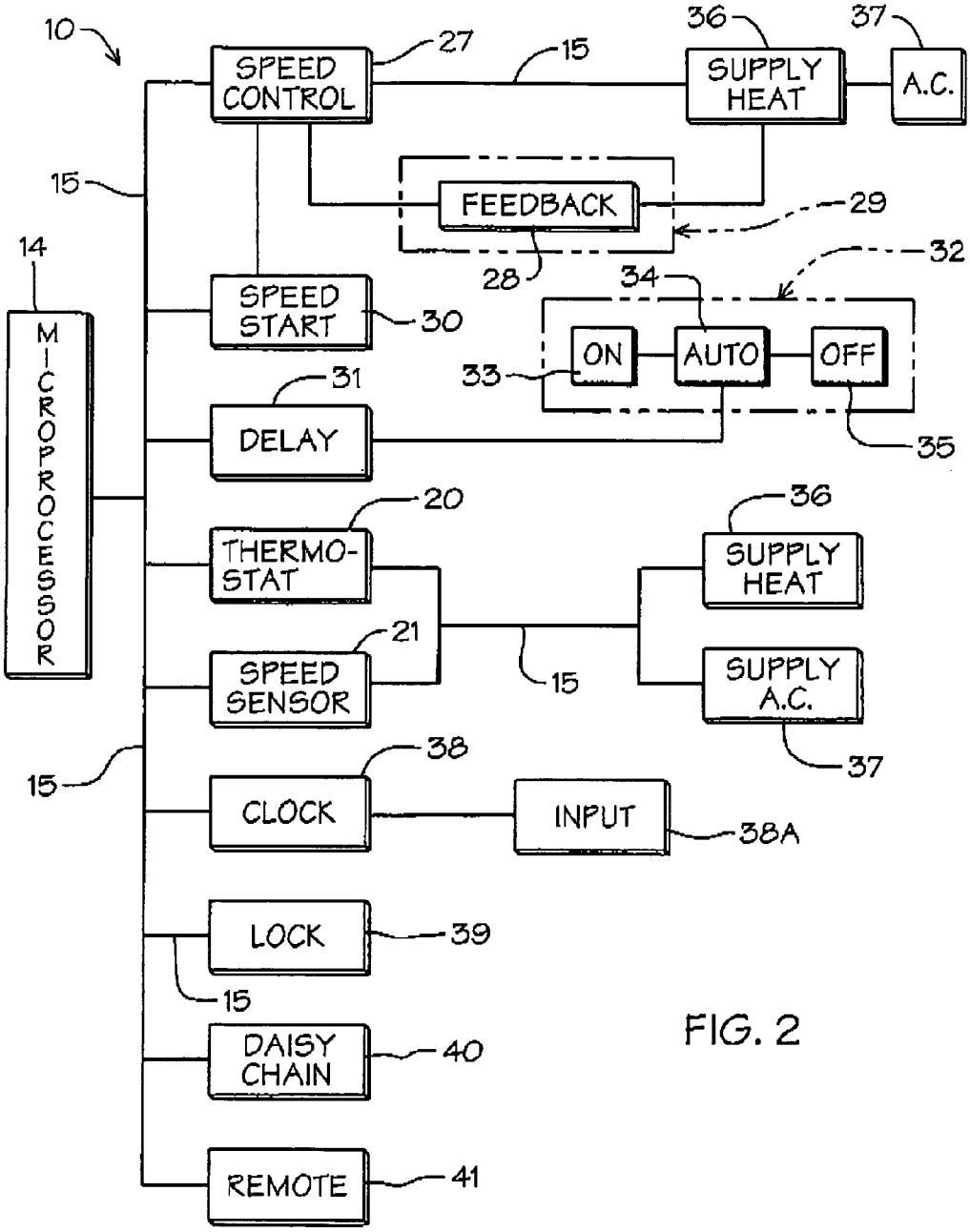
FIG. 2 is a block flow diagram illustrating specific operational control function elements.

Referring now to FIG. 2 of the drawings, the electronic air curtain controller 10 of the invention manages the proper and effective air curtain 11 operation illustrated by the controllers 10 operational feature function as follows.

A speed control function 27 controlling fan motor assembly's 16 speed directly via auxiliary controls (not shown) if required. A feedback circuit 28 function is provided that monitors and adjusts to maintain a given sent point for the fan motor assemblies 16. Optionally, such control parameters can also be utilized to manage the fan motor assemblies 16 such as pressure differentials between control spaces as indicated in broken lines graphically at 29.

An air curtain full speed start function 30 is used to initiate maximum fan motor assembly 16 speed to establish the initial air barrier rapidly in structures where the threshold is opened and protection must be rapidly established. The full speed start 30 function then employs a reduction of fan motor assembly's 16 speed once the air barrier is established to maintain an operational velocity.

The time delay function 31 determines how long the air curtain 11 runs after a threshold closure with control mode settings 32 comprising an on setting 33, auto setting 34 and off setting 35 which in this example is set to auto setting 34. Given the operational parameters, the on setting 33 manually enables the controller and correspondingly the off setting 35 disables the electronic controller 10. The auto setting 34 provides for enabilization by external control data input from the information data input element group 18 as hereinbefore described.

The functionality management by the internal thermostat 20 as hereinbefore described provides for home base control activation of supplemental heating unit 36 and cooling unit 37 of the air conditioning element 17.

Referring now to a clock function indicator at 38 which provides for an event base control wherein the control mode settings 32 are maintained based on the clock and input setting 38A via the communication network 15.

A programming lock mode function 39 will prevent non-authorized access to the operator settings imparting a control security oversight of the electronic controller 10.

In applications where multiple electronic controllers are used, the allowance for unlimited master slave inner control between the multiple connected controllers a so-called "daisy chain" functionality 40 is provided wherein a setting on one of the interconnected controllers 10 in such configurations will change the corresponding setting on all of the interconnected controllers 10 of the system via the serial input and output ports 26A and 26B as hereinbefore described.

As noted, the electronic controller 10 enabled with a remote control function 41 by the hereinbefore described infrared receiver 24 and command and control infrared transmitter 25.

It will thus be seen that a new and novel factory installed digital programmable controller 10 for environmental air curtain 11 applications has been illustrated and described and it will be apparent to those skilled in the art that various changes and modifications may be made therein without departing from the spirit of the invention.

Therefore i claim:

1. An integrated programmable electronic controller for air handling equipment comprises in combination, an air curtain apparatus to establish an airflow stream as an effective environmental barrier between temperature divergent environments, and multiple sensor interfaced with air curtain command and control, said controller having an integrated central microprocessor, a control data input group and a control element group;

a communication network interconnecting said air curtain and respective control data input and control element groups with said central microprocessor, said control data input group comprising, a first temperature sensor for obtaining an internal temperature value, a second temperature sensor for obtaining a remote temperature value of said temperature divergent environments, a fan motor speed sensor for adjusting air velocity of said air curtain, a threshold motion sensor, contact threshold sensor and a remote control sensor, said control element group comprising an air curtain fan motor assembly and air conditioning units, input data control values as functional control messages including a full speed start for said fan motor assemblies and operational time delay for said air curtain controller, means for communication with additional controllers, threshold control mode settings of said control data input group comprising an off setting, an on setting and an auto setting and a clock control for an event based control of said threshold control mode settings, network for transmitting data from said data input group and intercommunication transmission with said control element group and display means.

2. The integrated programmable electronic controller set forth in claim 1 wherein said means for communicating with additional electronic controllers comprise, serial inputs and output links.

3. The integrated programmable electronic controller set forth in claim 1 wherein said predefined set of function control messages include fan motor assembly, speed control, a data feedback circuit to maintain preset fan motor speed values.

4. The integrated programmable electronic controller set forth in claim 1 wherein said remote control sensor comprises, an infrared receiver and a remote located infrared control data transmitter.

5. The integrated programmable electronic controller set forth in claim 4 wherein said remote located infrared control data transmitter has preprogrammed control messages and imputable control messages for said control element group.

6. The integrated programmable electronic controller set forth in claim 1 wherein said first and second temperature sensor values define control data input activation of said air conditioning elements to heat, cool airflow stream and fan motor speed assemblies dependent on preprogrammable set values.

7. The integrated programmable electronic controller set forth in claim 1 wherein said threshold control mode settings further include, a programmable lock mode and multiple electronic control interface therewith.

* * * * *